US006840798B2

(12) United States Patent
Kobayashi

(10) Patent No.: US 6,840,798 B2
(45) Date of Patent: Jan. 11, 2005

(54) SHIELDING CONNECTOR, A SHIELDING CONNECTOR SYSTEM, A TERMINAL FITTING AND USE THEREOF

(75) Inventor: Yutaka Kobayashi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 8 days.

(21) Appl. No.: 10/369,034

(22) Filed: Feb. 14, 2003

(65) Prior Publication Data

US 2003/0171032 A1 Sep. 11, 2003

(30) Foreign Application Priority Data

Feb. 15, 2002 (JP) ..... 2002-038347
Feb. 19, 2002 (JP) ..... 2002-042199
Feb. 19, 2002 (JP) ..... 2002-042244
Feb. 28, 2002 (JP) ..... 2002-053992

(51) Int. Cl.[7] ..... H01R 12/24
(52) U.S. Cl. ..... 439/497; 439/610; 439/660
(58) Field of Search ..... 439/497, 610, 439/660, 607, 604, 605, 884, 395

(56) References Cited

U.S. PATENT DOCUMENTS 4,619,487 A 10/1986 Brush, Jr. ..... 439/98
4,648,673 A * 3/1987 Endo et al. ..... 439/395
5,190,470 A 3/1993 Soes et al.
5,618,202 A 4/1997 Okuyama et al. ..... 439/497
6,007,385 A 12/1999 Wu ..... 439/607
6,257,914 B1 * 7/2001 Comerci et al. ..... 439/357
6,364,702 B1 4/2002 Mochizuki et al.
2001/0036767 A1 11/2001 Igarashi

FOREIGN PATENT DOCUMENTS

JP 11-283710 10/1999

* cited by examiner

*Primary Examiner*—Hung V. Ngo
(74) *Attorney, Agent, or Firm*—Gerald E. Hespos; Anthony J. Casella

(57) ABSTRACT

A plug (20) has a base (22) in which a plurality of plug-side terminal fittings (50) are mounted and a lid portion (23) openably and closably mountable on the base (22). The base portion (22) includes a base-side shell (30) and a resin-made base-side housing (60) integrally formed with the base-side shell (30) by insert molding. Since the base-side housing (60) and the base-side shell (30) support each other while being held in close contact, a sufficient strength can be secured. Further, since it is not necessary to assemble the base-side housing (60) and the base-side shell (30), an assembling process can be simplified.

12 Claims, 20 Drawing Sheets

SHIELDING CONNECTOR, A SHIELDING CONNECTOR SYSTEM, A TERMINAL FITTING AND USE THEREOF

BACKGROUND OF THE INVENTION

1. Field of the Invention

The invention relates to a shielding connector, a shielding connector system and a terminal fitting.

2. Description of the Related Art

U.S. Pat. No. 6,364,702 discloses a shielding connector with a resin housing. Terminal fittings are connected individually with cores of a shielded flat cable and are inserted into the housing. The connector also has a base shell mounted on the bottom side of the housing and a lid shell mounted on the top side of the housing for shielding. The connector is assembled by mounting the base shell on the housing, then mounting an end of the flat cable in the housing, and finally mounting the lid shell. The cores of the shielded cables are connected with the corresponding terminal fittings, and the shielding shells are connected with all the shielding layers of the shielded cables on the completely assembled connector. Thus, shielding effects, such as removal of radiation noise, can be obtained.

The housing and the shielding shells of the above-described connector are made thin to meet a demand for the miniaturization. Thus, the housing and the shielding shells separately are weak. The housing and the shielding shells of the above-described connector are separate parts and are not in close contact with each other. Thus, a load may be exerted on the housing or one of the shield components, and may cause a deformation. Further, assembly of the housing and the shielding shells takes a long time.

Another shielded connector is shown in U.S. Patent Application Publication No. 2001/0036767 A1, and a rear part of that connector is shown in FIG. 22 herein. The connector of FIG. 22 is used with a flat cable 100 formed into a strip by applying a film to a plurality of side-by-side shielded cables 101. Shielding layers 102 of the shielded cables 101 are soldered to a pair of electrically conductive plates to define a shorting element 103 secured at an end of the flat cable 100. Cores (not shown) of the respective shielded cables 101 are exposed before the shorting element 103. The shorting element 103 is held in a housing 104 of the connector, and the cores of the respective shielded cables 101 are connected individually with terminal fittings (not shown) held in the housing 104. A shielding shell 105 is mounted to and covers the housing 104. The shielding shell 105 is connected with the shielding layers 102 of the cables 101 via the shorting element 103, and achieves shielding effects, such as removal of radiation noise. The shielded cables 101 are held tightly between an upper wall 105A of the shielding shell 105 and a rear wall 104A of the housing 104. Thus, a force in the thickness direction of the flat cable 100 will not be transferred to the portion S of the flat cable 100 where the shorting element 103 is secured.

The housing 104 and the shielding shell 105 are made thin to meet a demand for miniaturization. Thus, a pulling force in the thickness direction of the wire could deform the housing 104 and/or the shielding shell 105 sufficiently to cut the shielded cables 101 at the portions S adjacent the shorting element 103. Further, a pulling force in the thickness direction of the flat cable 100 could press the shielded cables 101 against the corners of the housing 104 and the shielding shell 105 and hence could damage the shielded cables 101.

A known shielding connector system is shown in Japanese Unexamined Patent Publication No. 11-283710. This system has a plug-side connector with a housing, terminal fittings fixed in the housing and a plug-side shell mounted over the outer surfaces of the housing. The plug-side connector is connected to an end of a flat cable that has been formed by arranging a plurality of shielded cables side by side. Cores of the respective shielded cables are connected with the terminal fittings by soldering, and shielding layers of the shielded cables are connected with the plug-side shell. This shielding connector system also includes a receptacle-side connector with a housing and terminal fittings that are fixed in the housing. A receptacle-side shell covers the outer surfaces of the housing and connects with an earth circuit on the circuit board. The terminal fittings of both connectors are mated by connecting the plug-side connector and the receptacle-side connector. Additionally, the plug-side shell and the receptacle-side shell are connected electrically with each other when the connectors are connected. Thus, shielding effects, such as the removal of radiation noise, can be obtained.

The above-described shielding connector system has a large number of parts because shielding shells are provided in both the plug-side and receptacle-side connectors. This leads to higher production costs and more assembling steps, and there has been a demand for improvements.

U.S. Pat. No. 5,190,470 and FIG. 23 herein disclose a terminal fitting 100 in the form of a long, narrow flat plate. A wire-squeezing portion 101 is defined at one end of the terminal fitting 100 and has a pair of parallel arms 101A. A tab-shaped terminal connecting portion 102 is provided at the opposed end of the terminal fitting 100 and is connectable with a mating terminal fitting (not shown). The arms 101A of the wire-squeezing portion 101 are resiliently deformable toward and away from each other, and electrical connection is established by resiliently squeezing a core 103A of a wire 103 in a slit 101B between the arms 101A.

Miniaturization of a connector (not shown) requires the entire length of the terminal fitting 100 to be shortened. However, the length of the terminal fitting 100 is at least a sum of a length L1 of the wire-squeezing portion 101 and a length L2 of the terminal connecting portion 103. An attempt to shorten the arms 101A of the wire squeezing portion 101 results in insufficient resiliency.

Accordingly, it is an object of the present invention to ensure good operability while allowing for a miniaturization.

SUMMARY OF THE INVENTION

The invention relates to a shielding a connector with a housing and terminal fittings that are mounted side-by-side in the housing. The terminal fittings are connected to cores of shielded cables. The connector also includes a shielding shell to be connected with shielding layers of the shielded cables and to shield the housing. The shielding shell comprises a base-side shell and a lid-side shell openably and closably mountable on or to the base-side shell.

The base-side shell and the housing are formed to be integral to each other by, e.g., insert molding. Accordingly, the housing and the base-side shell support each other and are in close contact. Thus, a sufficient strength can be secured. Further, it is unnecessary to assemble the housing and the base-side shell, and the assembling process can be simplified.

The base-side shell and the lid-side shell may be formed unitarily via a bendable coupling piece and can be assembled by bending the coupling piece. Accordingly, the number of parts can be reduced. Additionally, the shells can be assembled with each other by bending the coupling piece, and it is unnecessary to position the shells with respect to each other during assembly.

At least one of the base-side shell and the lid-side shell preferably has a double-plate structure by folding a conductive plate at a folded edge. Accordingly, a sufficient strength can be secured against a force pulling the cable in thickness direction. Further, the wire-pressing portion will not damage the cable because a smooth surface on the outer surface of the folded edge of the wire-pressing portion is brought into contact with the cable.

The base-side shell and the lid-side shell preferably comprise a pair of wire-pressing portions for squeezing the cable in opposite thickness directions at a rear end of the housing where the cable is drawn out. The wire-pressing portion may bring an outer surface of the folded edge into contact with the cable. Accordingly, the shielding connector secures sufficient strength against a pulling force on the cable and prevents the cable from being damaged. The wire-pressing portion may be formed in the one shell by bending a portion near the folded edge at a rear end of the connector in such a manner as to extend in a thickness direction of the cable.

The invention also relates to a shielding connector system, comprising: a plug-side connector, as described above, and a receptacle-side connector for a circuit board. Plug-side terminal fittings are held in a plug-side housing of the plug-side connector and are connectable with the respective shielded cables. Receptacle-side terminal fittings are held in a receptacle-side housing of the receptacle-side connector and are configured for connection to a circuit board. Connecting the plug-side connector with the receptacle-side connector connects the plug-side terminal fittings with the corresponding receptacle-side terminal fittings. A shielding shell is provided in one of the plug-side connector and the receptacle-side connector and comprises an integral plug-side shield for connecting to and substantially covering the ends of the shielded cables. The shielding shell also comprises a receptacle-side shield for substantially covering the receptacle-side terminal fittings. Accordingly, the number of parts can be reduced since the shielding shell is provided in only one of the plug-side connector and the receptacle-side connector.

The shielding shell preferably is in the plug-side connector and has integral terminals that connect with at least some of the receptacle-side terminal fittings. Accordingly, no separate member is needed for connection to all receptacle-side terminal fittings, and the construction is simplified.

The receptacle-side terminal fittings are arrayed alternately in two rows so that rows of the plug-side terminal fittings are between the rows of the receptacle-side terminal fittings. Accordingly, the arrangement interval of the receptacle-side terminal fittings can be twice as large as the interval of the shielded cables. Thus, the width of the receptacle-side terminal fittings and the width of the terminals of the shielding shell can be enlarged as much as the arrangement interval of the receptacle-side terminal fittings is enlarged. This results in better electrical conduction and better shielding effects.

The invention also relates to a terminal fitting formed of a long, narrow electrically conductive plate. The terminal fitting has a wire-squeezing portion with side-by-side arms to establish electrical connection by squeezing a wire between the arms. The terminal fitting further has a terminal connecting portion that is connectable with a mating terminal fitting. The wire squeezing portion and the terminal connecting portion are folded back to substantially face and/or overlap each other in the thickness direction. Accordingly, the length of the terminal fitting is less than a sum of the lengths of the wire squeezing portion and the terminal connecting portion. Thus, a connector in which the terminal fittings are mounted can be miniaturized.

A coupling portion preferably is provided between the wire squeezing portion and the terminal connecting portion. The wire squeezing portion is folded back so that the terminal fitting has a substantially S-shape.

The wire-squeezing portion and the terminal connecting portion extend in opposite directions. Thus, the terminal fittings can be formed while coupled to a carrier strip via connecting pieces that extend from the ends of the terminal connecting portions.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
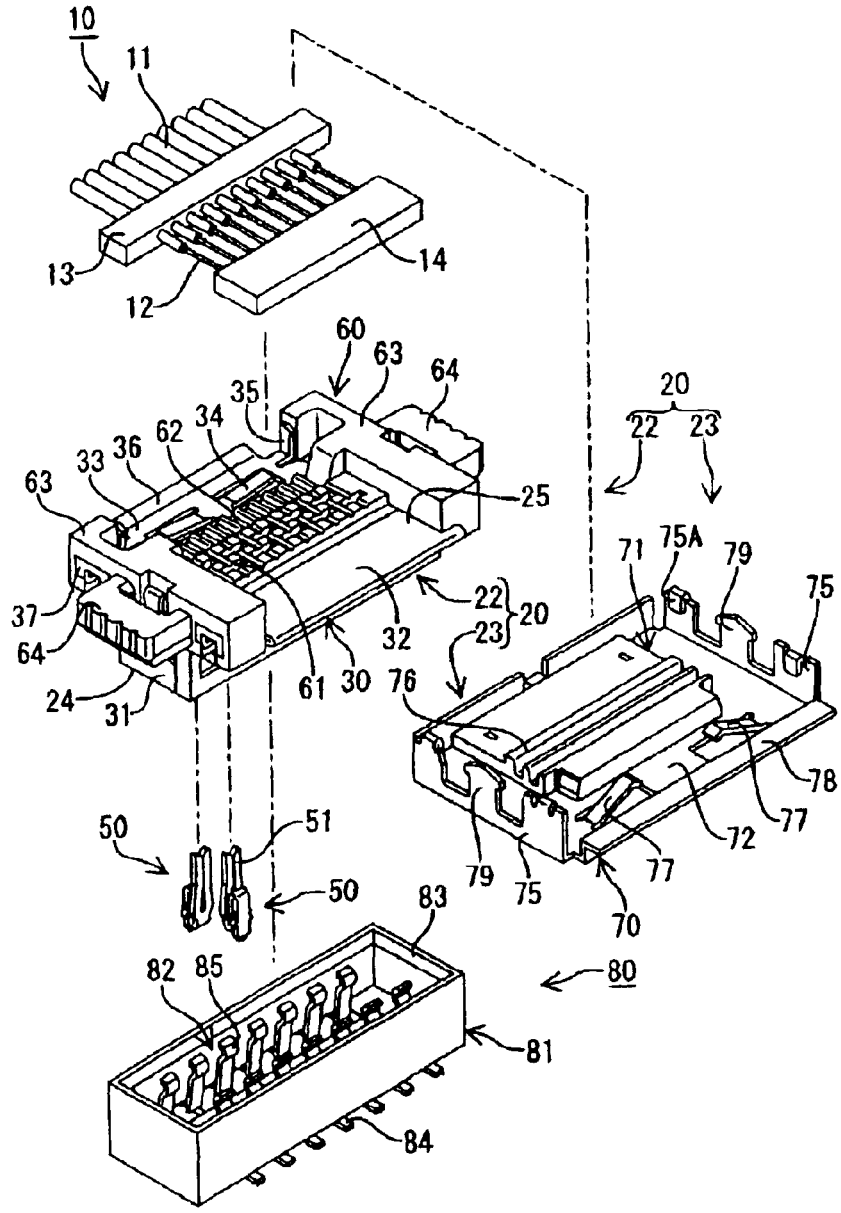
FIG. 1 is an exploded perspective view showing a plug and a receptacle according to a first embodiment of the invention.

A shielding connector according to the invention is used with a flat cable identified by the numeral 10 in FIG. 1. The flat cable 10 has a plurality of side-by-side shielded cables 11, each of which has a core 12 exposed at an end of the flat cable 10. A shorting plate 13 is fixed and shorted to shielding layers (not shown) of the shielded cables 11 at a side of the flat cable 10 behind the exposed cores 12. Leading ends of the cores 12 are held at specified intervals by an alignment sheet 14.

The shielding connector is a plug identified by the numeral 20 in FIG. 1. The plug 20 has a base 22 and a lid 23 that can be mounted on and removed from the base 22. The base 22 has a fittable portion 24 in the form of a wide box that can be fit into a receptacle 80. A substantially groove-shaped cable-connecting portion 25 is at the upper end of the fittable portion 24 and extends in longitudinal directions of the flat cable 10. The fittable portion 24 and the cable-connecting portion 25 comprise a base-side shell 30 and a base-side housing 60 formed integrally with the base-side shell 30.

Figure 2:
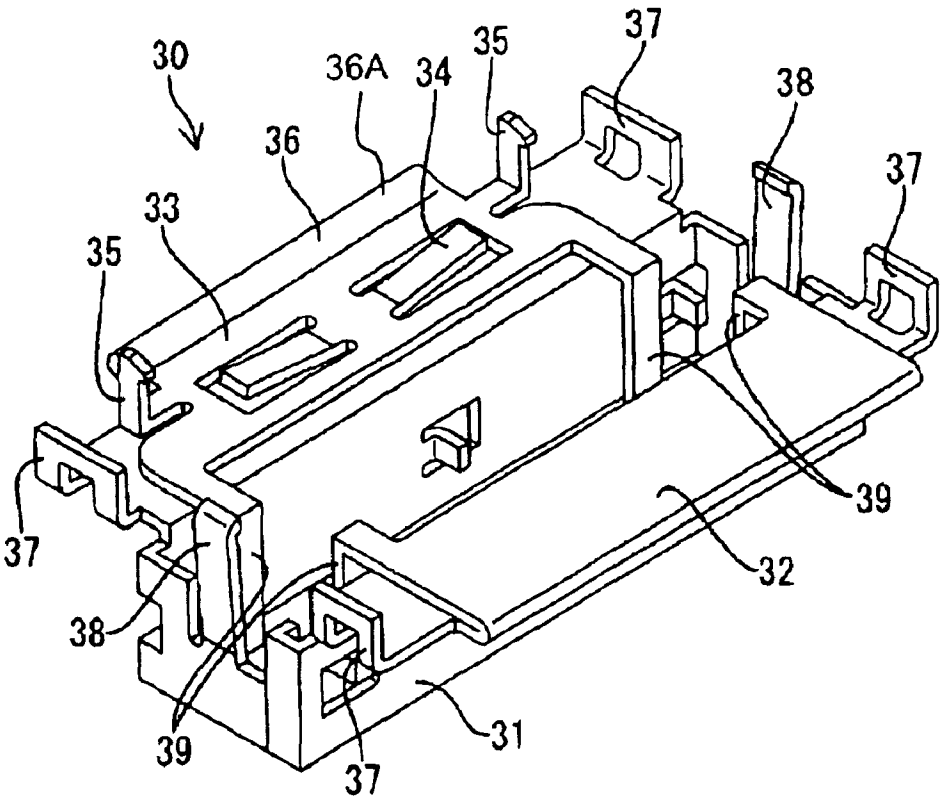
FIG. 2 is a perspective view of a base-side shell.
Figure 3:
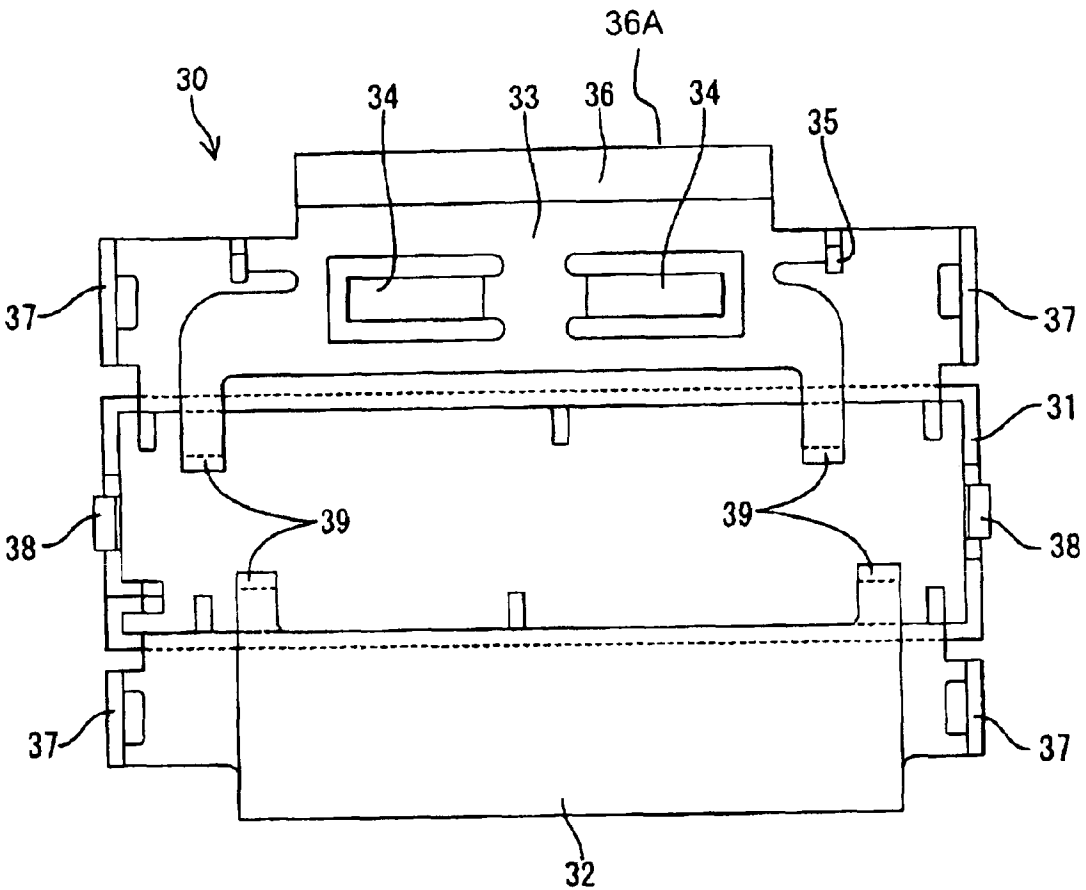
FIG. 3 is a plan view of the base-side shell.
Figure 4:
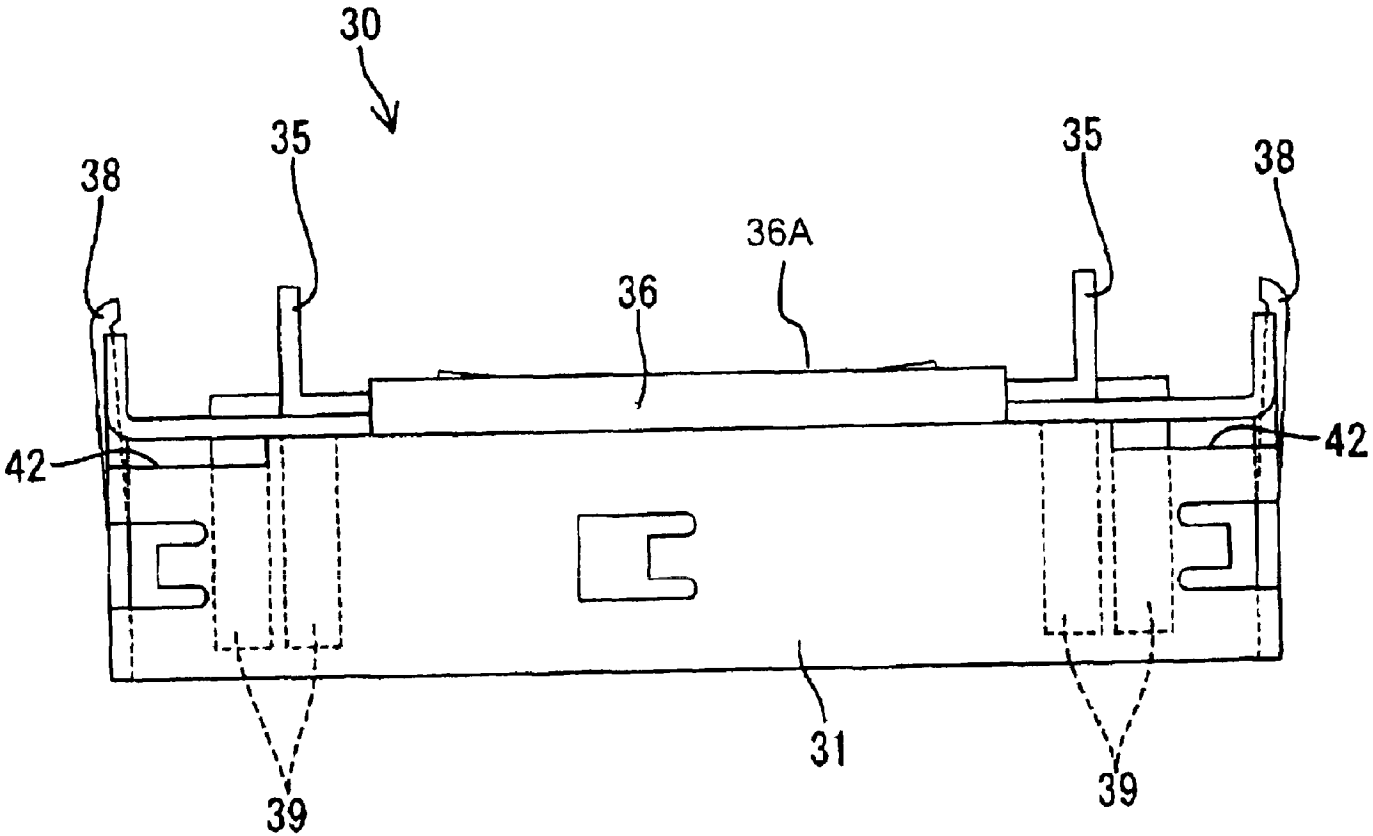
FIG. 4 is a rear view of the base-side shell.
Figure 5:
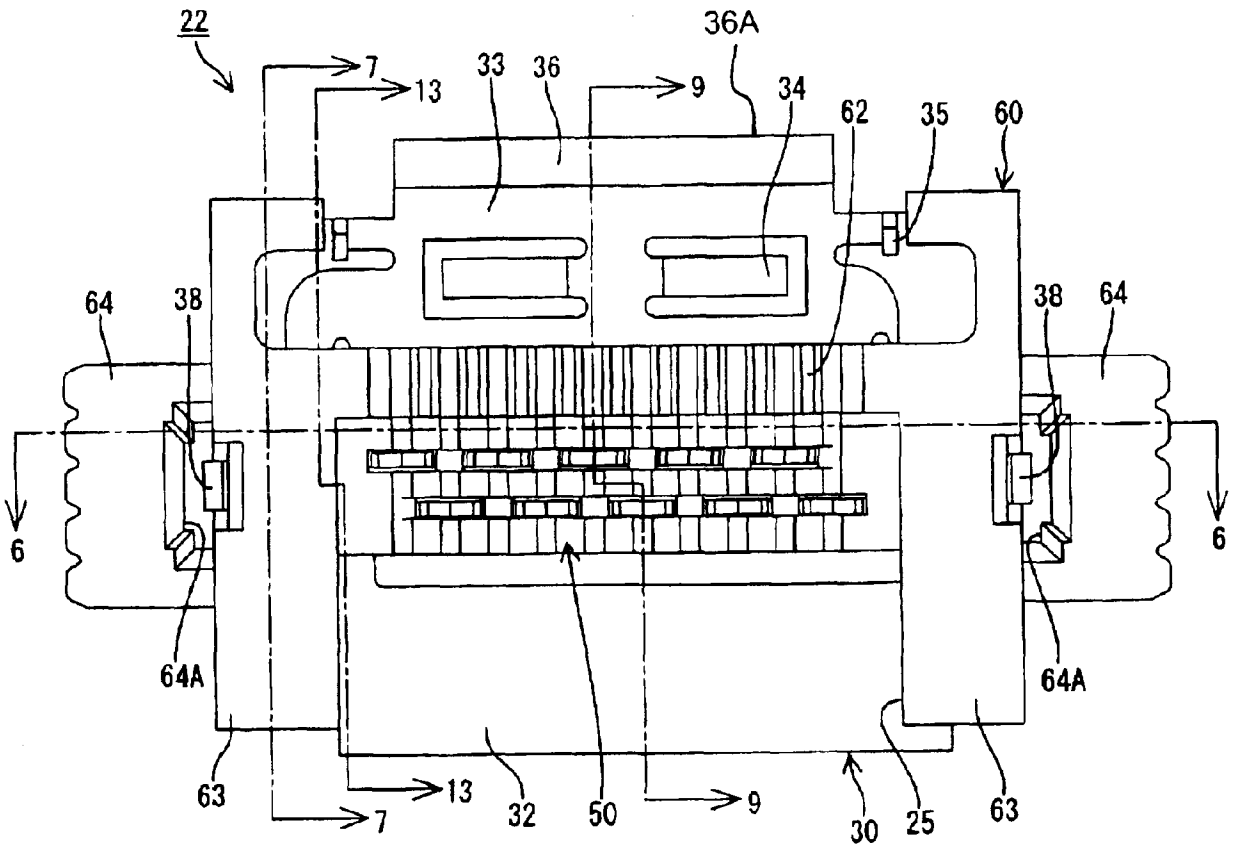
FIG. 5 is a plan view of a base portion.
Figure 6:
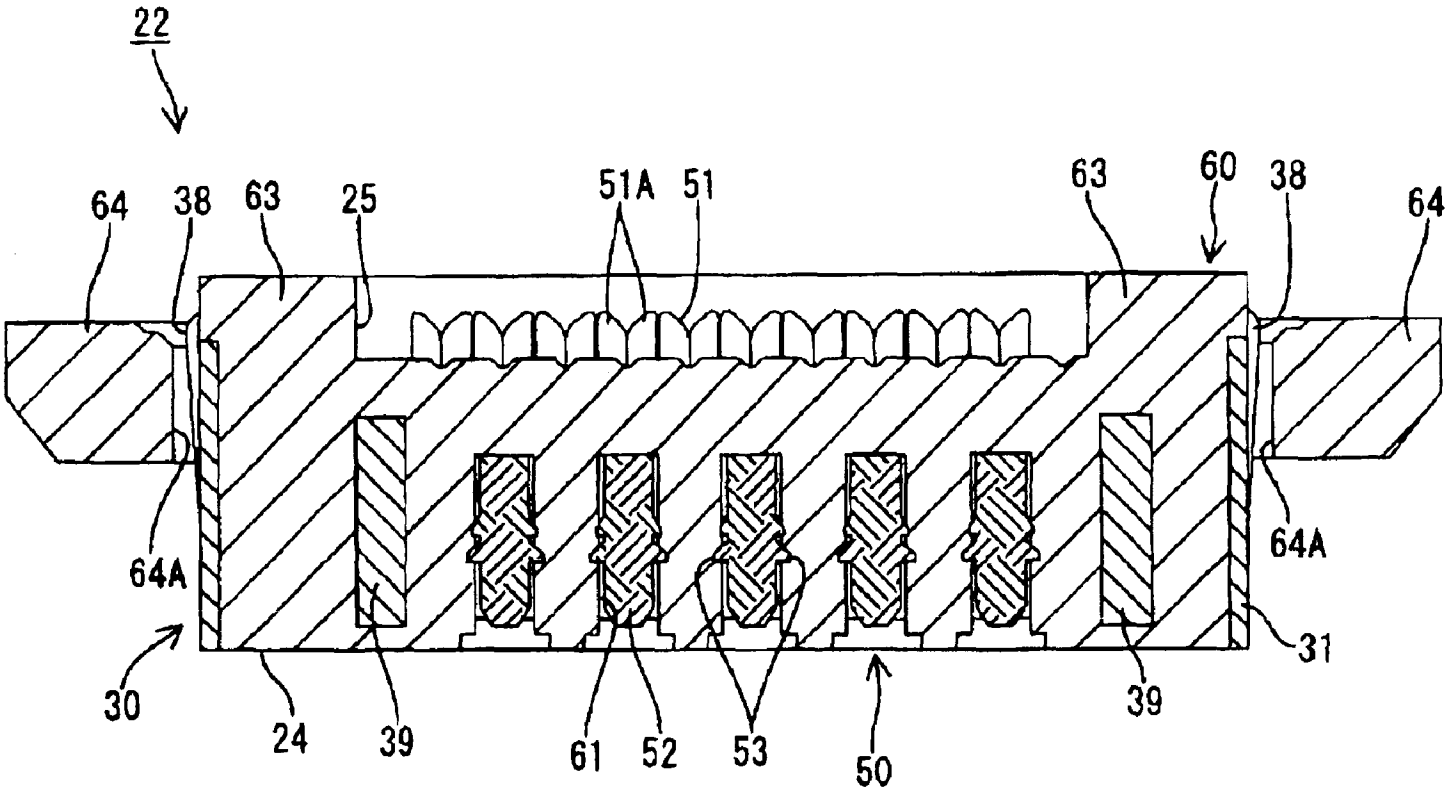
FIG. 6 is a section along 6—6 of FIG. 5.
Figure 9:
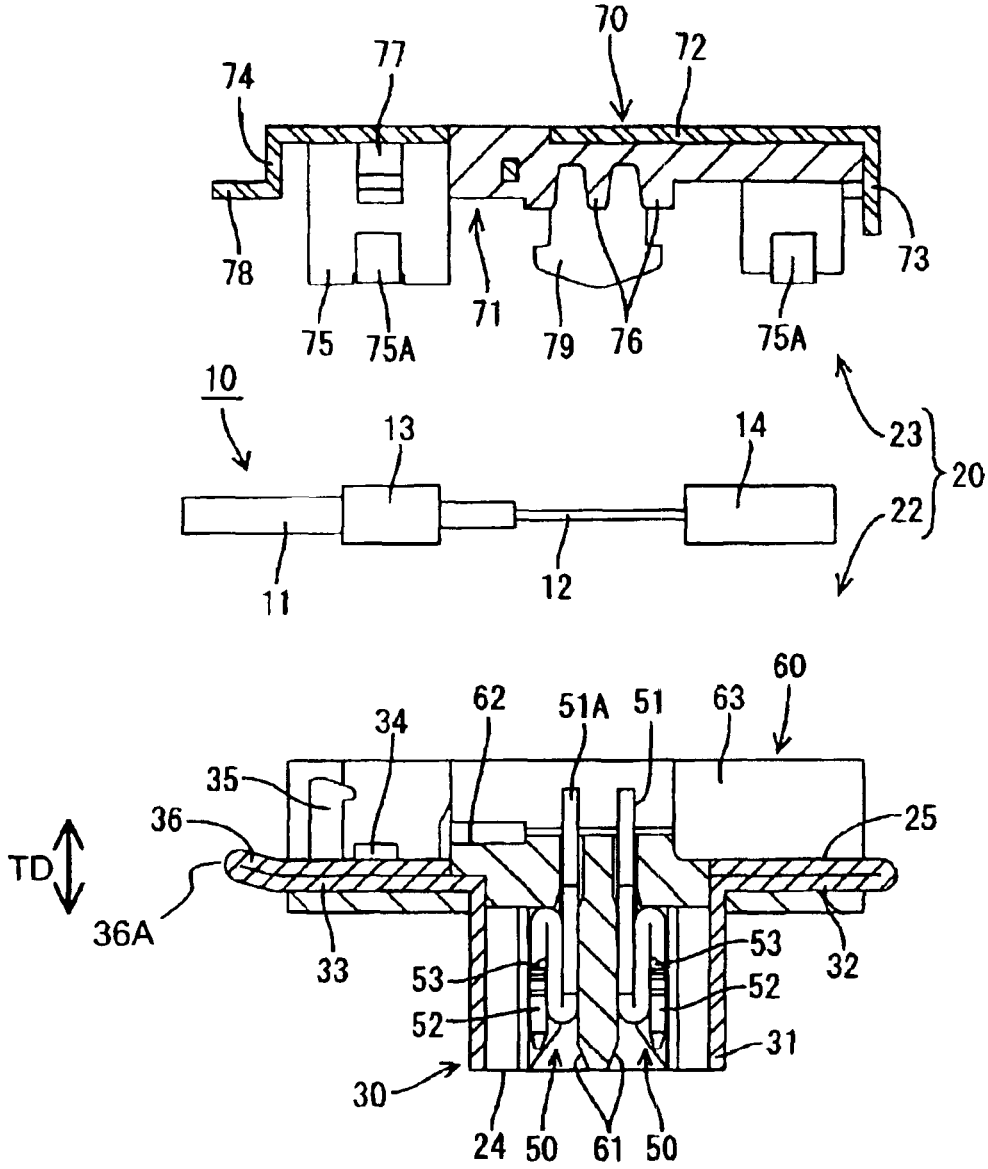
FIG. 9 is a section along 9—9 of FIG. 5 showing a state before a flat cable and the lid portion are assembled with the base portion.

The base-side shell 30, as shown in FIGS. 2 to 4, is formed by bending, folding and/or embossing a single electrically conductive metallic plate stamped or cut out into a specified shape. A bottom part of the base-side shell 30 is formed into a substantially rectangular tube 31 with open upper and lower ends. The rectangular tube 31 forms a substantially outer surrounding wall of the fittable portion 24. A front bottom plate 32 extends horizontally forward from the front edge of the upper end of the rectangular tube 24, and a rear bottom plate 33 extends horizontally back from the rear edge thereof. The two bottom plates 32, 33 form a part of the bottom surface of the cable-connecting portion 25 on which the flat cable 10 is to be placed. As shown in FIG. 9, each bottom plate 32, 33 has a double-plate structure in a greater part of its area by folding a corresponding section of the metallic plate at the front or rear end. Left and right resilient supports 34 are formed by cutting the rear bottom plate 33 and bending these cut portions obliquely up. Fixing pieces 35 project vertically at the left and right sides of the left and right supports 34 and a wire press 36 is bent obliquely up at the rear end of the rear bottom plate 33 near a folded edge 36A of the conductive metallic plate. Locking pieces 37 stand vertically at the left and right ends of each bottom plate 32, 33, and resilient contacts 38 project obliquely up to the outer side of the left and right side walls of the rectangular tube 31. Four terminals 39 extend from left and right ends of the upper surface of the bottom plates 32, 33 and hang down inside the rectangular tube 31.

The base-side housing 60 is formed e.g. of a synthetic resin and is made integral with the base-side shell 30 by insert molding (see FIGS. 5 to 7 and 9). Thus, parts of the base-side shell 30 are surrounded and supported by a unitary matrix of the resin that forms the base-side housing 60. Terminal mount holes 61 are formed in the fittable portion 24 of the base side housing 60 and have open upper and bottom ends. Plug-side terminal fittings 50 are mountable into the corresponding terminal mount hole 61. The terminal mount holes 61 are arrayed substantially side-by-side substantially along the widthwise direction in front and rear rows. However, the terminal mount holes 61 in the front row are offset from those of the rear row and are in reverse orientation along forward and backward directions. Specifically, the terminal mount holes 61 of the front row are offset from those of the rear row by half the interval between them.

Each terminal fitting 50 is formed from a long narrow electrically conductive metallic plate 170 (see FIG. 20) and includes a wire squeezing portion 51 with two side-by-side arms 51A at one longitudinal end. A flat terminal connecting portion 52 is at the opposite longitudinal end and a flat coupling portion 53 is between the wire squeezing portion 51 and the terminal-connecting portion 52. The wire-squeezing portion 51 is folded back and is in close contact with one surface of the coupling portion 53, whereas the terminal connecting portion 52 is folded back and is in close contact with the other surface of the coupling portion 53. Thus, the terminal fitting 50 has an S-shape so that the wire-squeezing portion 51 and the terminal-connecting portion 52 project in substantially opposite directions. The arms 51A of the wire-squeezing portion 51 are substantially in contact with each other in their natural undeflected state, but are resiliently deformable away from each other. As a result, the core 12 of the flat cable 10 can be inserted into a slit 51B between the arms 51A and can be squeezed by the arms 51A to establish an electrical connection. Upper and lower pressing projections 54 are formed at each side end of the terminal connecting portion 52 and bite into the inner wall of the terminal mount hole 61 when the terminal fitting 50 is inserted into the terminal mount hole 61 from below. Thus, the pressing projections 54 prevent the terminal fitting 50 from coming out. The leading end of the wire-squeezing portion 51 projects up from the bottom surface of the cable connecting portion 25 when the terminal fitting 50 is mounted in the terminal mount hole 61, and hence the wire squeezing portion 51 is connectable with the core 12 of the flat cable 10. The terminal connecting portion 52 is connectable with the corresponding receptacle-side terminal fitting 82 inside the fittable portion 24. The terminals 39 of the base-side shell 30 are spaced apart from the leftmost and rightmost terminal connecting portions 52 by a distance substantially equal to the interval between the terminal connecting portions 52, and are connectable with the receptacle-side terminal fittings 82.

Figure 20:
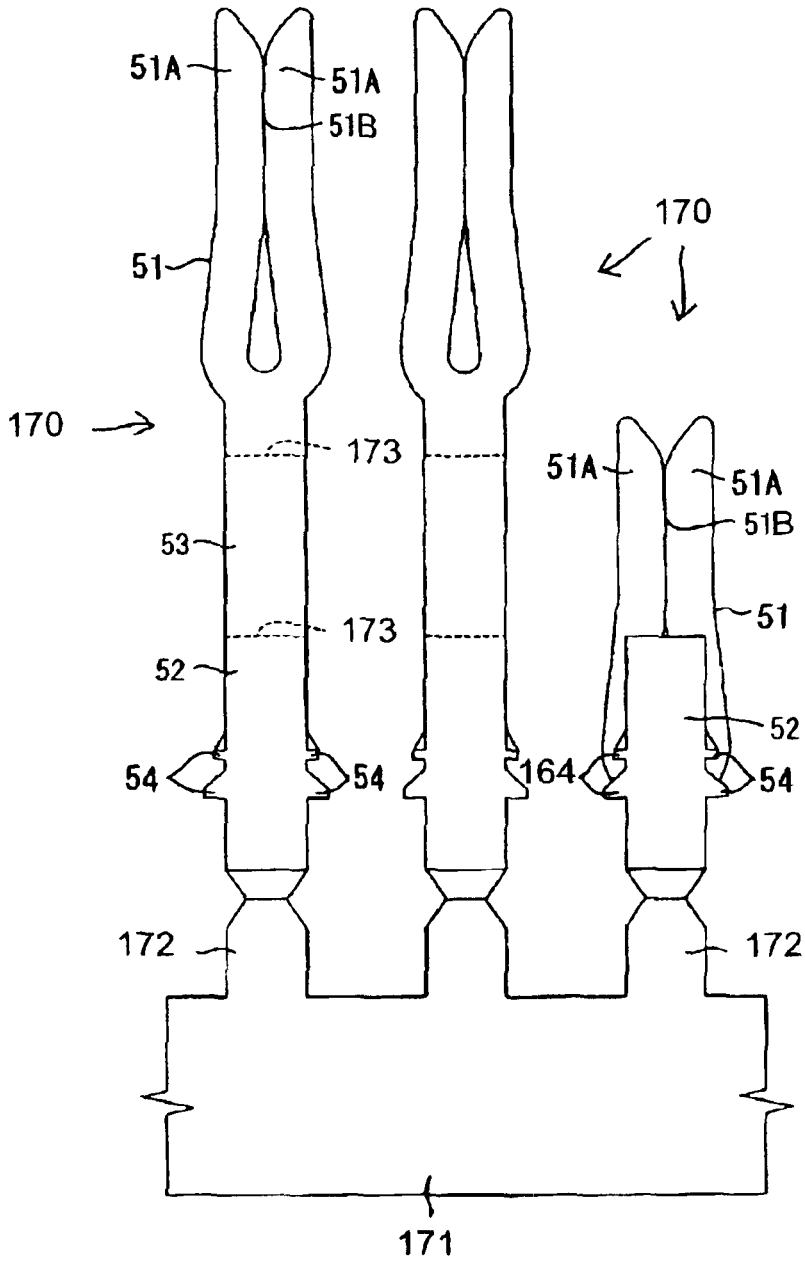
FIG. 20 is a plan view showing a production process of the terminal fittings.

The terminal fittings 50 are formed from a single electrically conductive metallic plate that is stamped or cut into many conductive metallic plate pieces 170 that are developments or blanks for the terminal fittings 50. The metallic plate pieces 170 are connected with each other along the widthwise direction via a strip-shaped carrier 171, as shown in FIG. 20. Each metallic plate piece 170 is coupled to the carrier 171 via a connecting piece 172 that extends longitudinally from an end of the metallic plate piece 170 at a portion that will become the terminal connecting portion 52. Each metallic plate piece 170 is folded at longitudinal end positions 173 of the coupling piece 53 to bring the wire squeezing portion 51 into close contact with one surface of the coupling portion 53 and to bring the terminal connecting portion 52 into close contact with the other surface of the coupling portion 53 (see metallic plate piece 170 at the right side of FIG. 20). The completed terminal fittings 50 can be obtained by separating the respective metallic plate pieces 170 from the connecting pieces 172.

Figure 19:
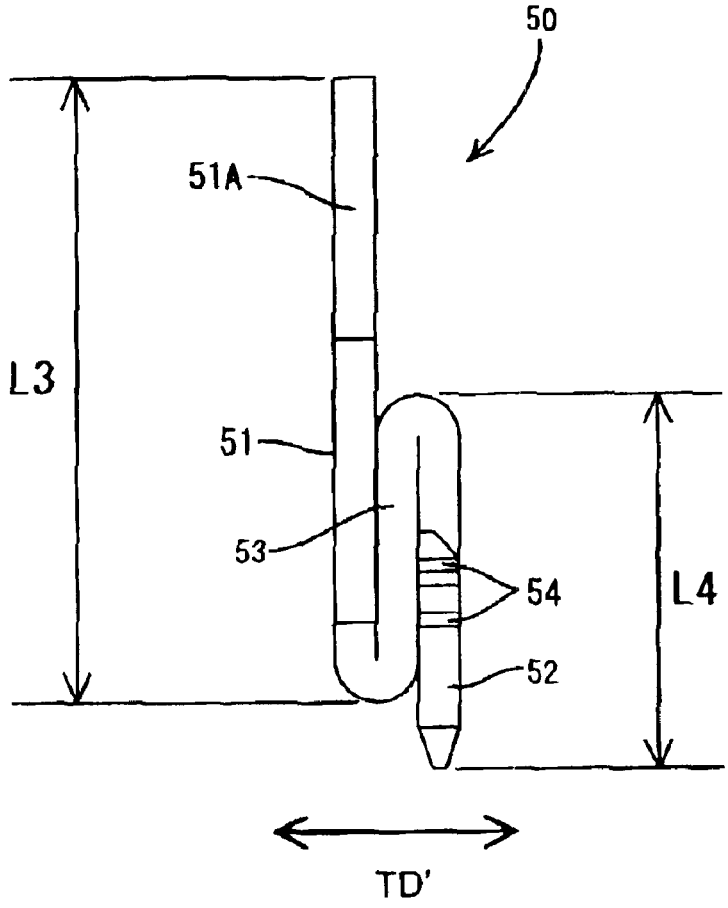
FIG. 19 is a side view of the terminal fitting.

The wire squeezing portion 51 and the terminal connecting portion 52 are folded back to overlap each other in thickness direction TD'. Thus, the entire length of the terminal fitting 50 can be made smaller than a sum of a length L3 of the wire squeezing portion 51 and a length L4 of the terminal connecting portion 52 (see FIG. 19). Thus, the terminal fittings 50 enable the plug-side connector 20 to be miniaturized by reducing the height.

Figure 7:
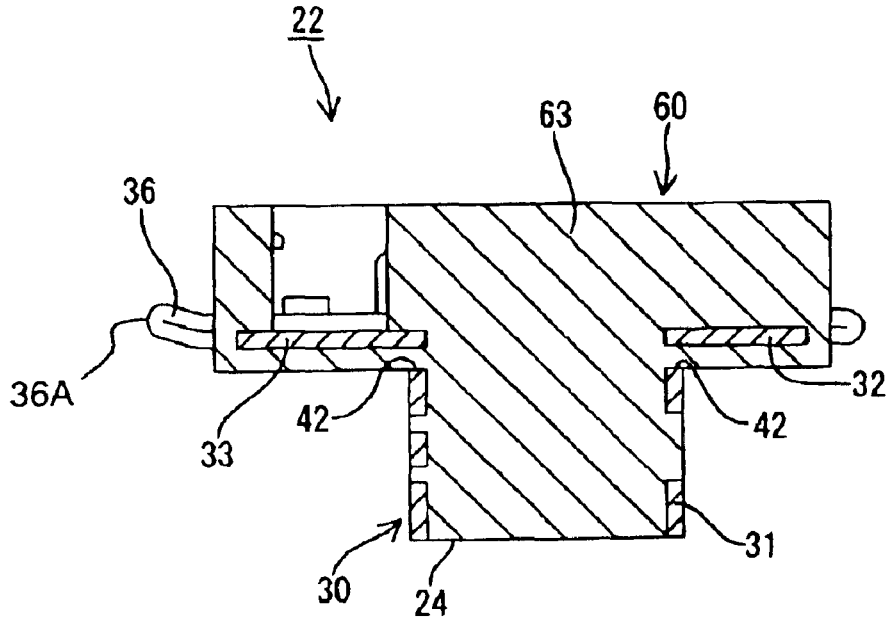
FIG. 7 is a section along 7—7 of FIG. 5.

Grooves 62 are formed in the bottom surface of the cable-connecting portion 25 of the base-side housing 60 and separate the respective shielded cables 11 of the flat cable 10. Sidewalls 63 are formed at the left and right sides of the cable-connecting portion 25 and extend in forward and backward directions. As shown in FIG. 7, the sidewalls 63 are formed to surround the left and right sides of the base plates 32, 33 of the base-side shell 30. The base shell 30 is formed with through holes 42 at upper end positions of the rectangular tube 31 in portions embedded in the sidewalls 63 (see FIGS. 4 and 7). The through holes 42 permit resin to flow to the rear sides of the bottom plates 32, 33 while molding the base-side housing 60. A finger-placing portion 64 projects from the outer side surface of each side wall 63, and a vertically hollow locking hole 64A is formed in each finger-placing portion 64. The leading ends of the resilient contacts 38 are located inside the locking holes 64A.

Figure 8:
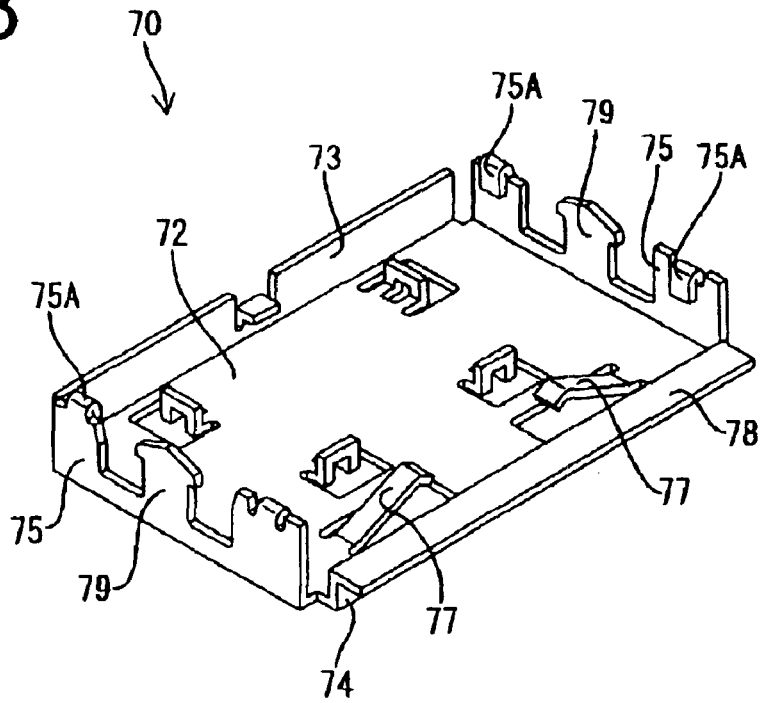
FIG. 8 is a perspective view of a lid-side shell.

The lid 23, as shown in FIGS. 1 and 9, has a lid-side shell 70 and a lid-side housing 71 integrally formed with the lid-side shell 70. The lid-side shell 70 is formed into a shape to be mountable on and cover the cable-connecting portion 25 shown in FIG. 8 by bending, folding and/or embossing a single electrically conductive metallic plate. Specifically, the lid-side shell 70 has a substantially rectangular ceiling wall 72. A front wall 73, a back wall 74 and a pair of sidewalls 75 extend substantially perpendicularly from the outer periphery of the ceiling wall 72. The lid-side housing 71 is formed e.g. of a synthetic resin and is made integral to the lower surface of the ceiling wall 72 of the lid-side shell 70 by insert molding. Thus, portions of the lid-side shell 70 are sounded and supported by a unitary matrix of the resin of the lid-side housing 71. This lid-side housing 71 is substantially in the form of a plate that extends along the ceiling wall 72, and pressing ribs 76 project from the lower surface thereof. The lid 23 is assembled with the base 22 so that the pressing ribs 76 press the cores 12 of the flat cable 10 sufficiently to establish a secure contact between the cores 12 and the spring contacts 51. The ceiling wall 72 is formed with left and right resilient pressing pieces 77 by cutting the lid-side housing 71 and bending the cut portions to project obliquely down. A wire pressing portion 78 extends horizontally back from the bottom end of the back wall 74 and holds the flat cable 10 tightly between the wire pressing portion 78 and the folded edge 36A of the wire pressing portion 36 of the base-side shell 30. Each sidewall 75 has locking projections 75A that engage the corresponding locking pieces 37, and a press-in portion 79 that can be pressed into the locking hole 64A is formed substantially in the middle of the side wall 75.

Figure 10:
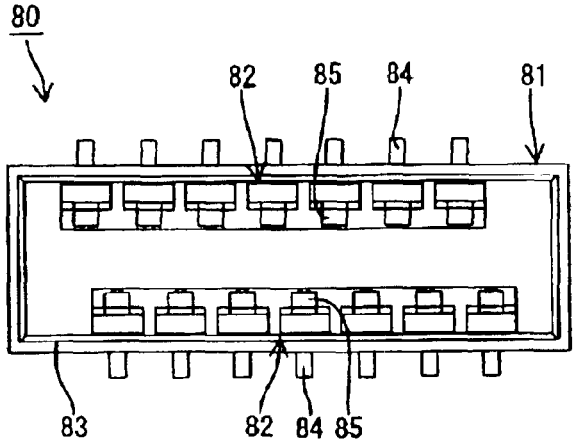
FIG. 10 is a plan view of the receptacle.
Figure 11:
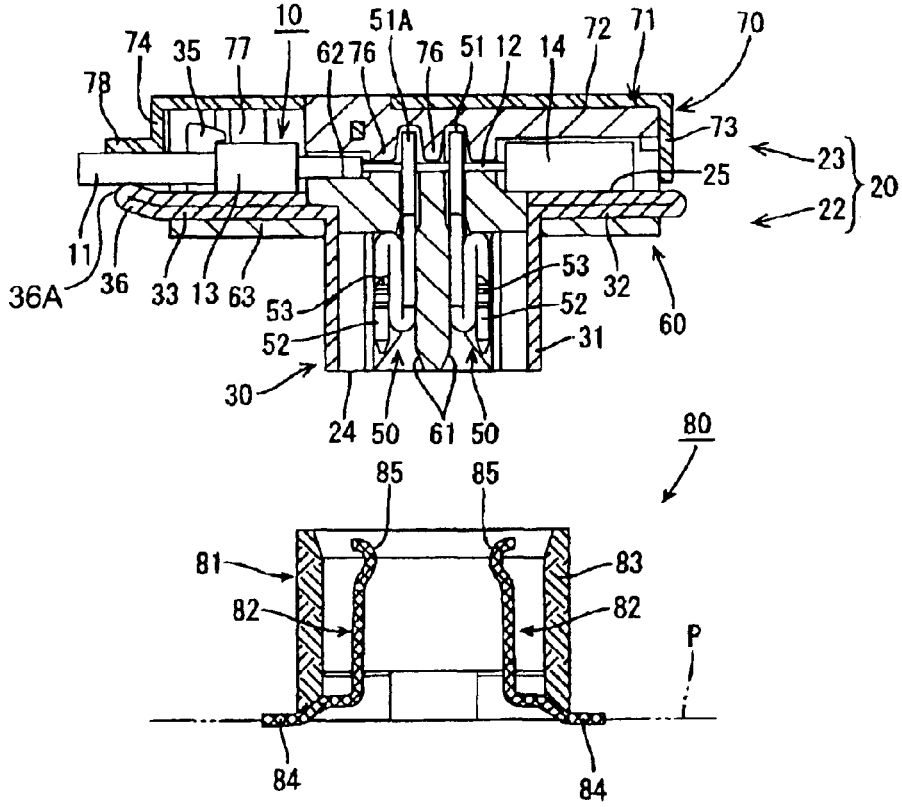
FIG. 11 is a section similar to FIG. 9, but showing a state before the plug and the receptacle are connected.

The receptacle 80, as shown in FIGS. 1, 10 and 11, has e.g. a synthetic-resin receptacle-side housing 81 and receptacle-side terminal fittings 82. The receptacle-side housing 81 includes a substantially tubular fitting 83 with an open upper end and a lower end that can be secured to the circuit board P. Terminal fittings 82 are arrayed transversely at specified intervals in each of two rows at the front and rear sides of the tubular fitting 83. The front receptacle-side terminal fittings 82 and the rear receptacle-side terminal fittings 82 are offset to each by a distance substantially equal to half the interval between the terminal fittings 82. Each receptacle-side terminal fitting 82 is made of an electrically conductive metal. A board connecting portion 84 is formed at one end of the receptacle-side terminal fitting 82 and extends horizontally out from the bottom of the tubular fitting 83 and can be connected with a circuit on the circuit board P by soldering. The board connecting portions 84 of the receptacle-side terminal fittings 82 at the opposite ends of the front and rear rows are connected with earth circuits on the circuit board P. A resilient contact piece 85 is formed at the other end of each receptacle-side terminal fitting 82 and extends inside the tubular fitting 83. The rows of the plug-side terminal fittings 50 are held between the two front and rear rows of the receptacle-side terminal fittings 82 when the plug 20 is fit in the receptacle 80. The receptacle-side terminal fittings 82, excluding those at opposite ends of the front and rear rows, are connectable with the terminal connecting portions 52 of the plug-side terminal fittings 50 by the resilient contact piece 85, and those at the opposite ends of the front and rear rows are connectable with the terminal portions 39 of the base-side shell 30 by the resilient contact pieces 85.

The plug 20 is assembled by inserting the plug-side terminal fittings 50 into the terminal mount holes 61 of the base-side housing 60 from below so that the pressing projections 53 bite into inner walls of the terminal mount holes 61. Thus, the plug-side terminal fittings 50 will not come out.

Subsequently, the end of the flat cable 10 is placed on the cable-connecting portion 25 from above. Thus, the shorting plate 13 is fixed by the fixing pieces 35 and the cores 12 are held in the spring contact portions 51 of the corresponding plug-side terminal fittings 50.

The lid 23 then is mounted to cover the cable-connecting portion 25 from above (see FIG. 11). The lid 23 and the base 22 are locked in their closed state by engaging the respective locks 75A with the locking pieces 37 and pushing the press-in portions 79 into the locking holes 64A. In this state, the resilient supporting pieces 34 of the base-side shell 30 and the resilient pressing pieces 77 of the lid-side shell 70 are held resiliently in contact with the shorting plate 13 of the flat cable 10 from above and below. As a result, both shells 30, 70 are connected electrically with the shielding layers of the shielded cables 11. Further, the resilient contacts 38 of the base-side shell 30 are held in resilient contact with the press-in portions 79 of the lid-side shell 70 to electrically connecting both shells 30, 70. Additionally, the shielded cables 11 of the flat cable 10 are held tightly between the wire pressing portions 36, 78 of the shells 30, 70 at the rear end of the cable-connecting portion 25. In this way, the plug 20 is assembled completely.

Figure 12:
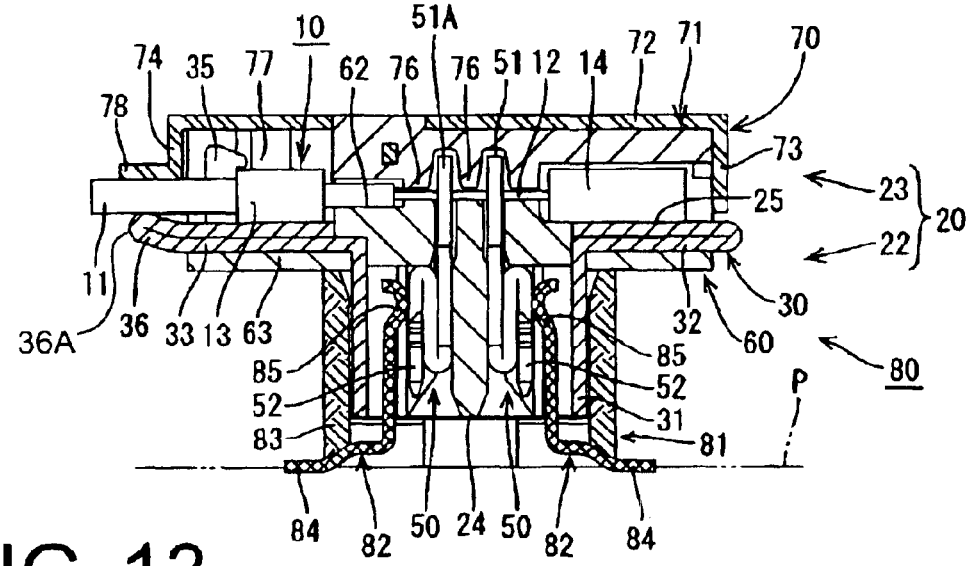
FIG. 12 is a section similar to FIG. 9, but showing a state where the plug and the receptacle are connected.
Figure 13:
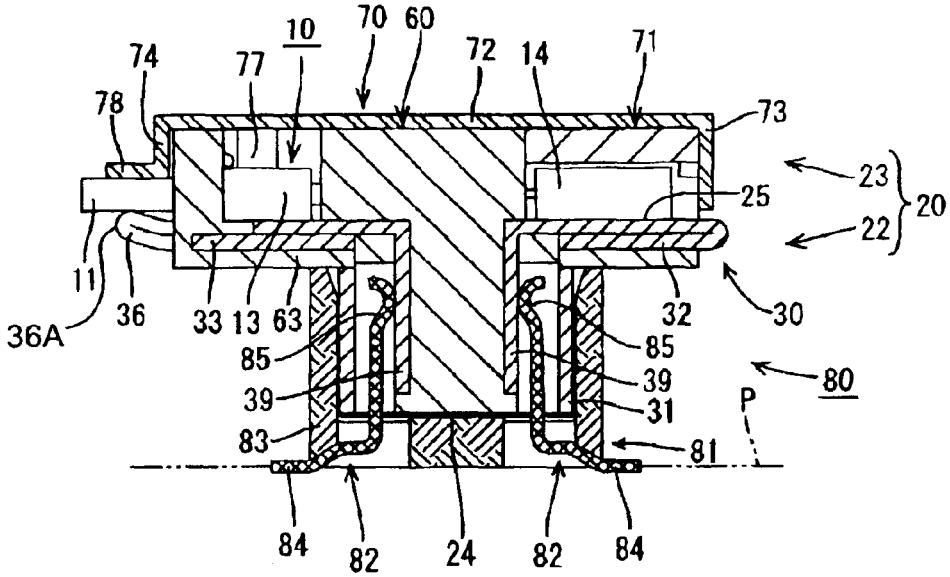
FIG. 13 is a section along 13—13 of FIG. 5 showing the state where the plug and the receptacle are connected.

The fittable portion 24 of the plug 20 then is fit into the tubular fitting 83 of the receptacle 80. Thus, the resilient contact pieces 85 of the receptacle-side terminal fittings 82, excluding those at the opposite ends of the front and rear rows, resiliently contact the terminal connecting portions 52 of the plug-side terminal fittings 50 (see FIG. 12). Additionally, the resilient contact pieces 85 of the receptacle-side terminal fittings 82 at the opposite ends of the front and rear rows resiliently contact the terminal portions 39 of the shells 30, 70 (see FIG. 13). Thus, the cores 12 of the shielded cables 11 of the flat cable 10 are connected with the circuit board P via the terminal fittings 50, 82 at the opposite sides, and the shielding layers of the flat cable 10 are connected with the circuit board P via the shells 30, 70 and the receptacle-side terminal fittings 82. As a result, the shells 30, 70 substantially surround the cable connecting portion 25 and the fittable portion 24. More particularly, the end of the flat cable 10 is covered by the bottom plates 32, 33 of the base-side shell 30 and the lid-side shell 70, and the receptacle-side terminal fittings 82 are covered by the substantially rectangular tube 31 of the base-side shell 30. Therefore, shielding effects, such as removal or reduction of radiation noise, can be obtained in both the plug 20 and the receptacle 80.

The base-side housing 60 and the base-side shell 30 are formed integrally and hence support each other. Thus, a sufficient strength can be secured. Further, it is unnecessary to assemble the base-side housing 60 and the base-side shell 30, and an assembling process can be simplified.

The base-side shell 30 has a double-plate structure. Thus, a sufficient strength can be secured against a downward pulling force on the flat cable 10 in thickness direction TD. Accordingly, the flat cable 10 will not be cut adjacent the shorting plate 13. Further, the smooth outer surface of the folded edge 36A of the wire pressing portion 36 contacts the flat cable 10, and hence the wire pressing portion 36 will not damage the flat cable 10.

The number of parts can be reduced since the base-side shell 30 is provided in only one of the plug 20 and the receptacle 80.

Further, the base-side shell 30 is connected with the circuit board P using some of the receptacle-side terminal fittings 82. Therefore, no separate member is required for such a connection, and the construction is simplified.

The receptacle-side terminal fittings 82 are arranged in an offset manner, with the arrangement interval being twice as large as that of the shielded cables 11. Thus, the widths of the receptacle-side terminal fittings 82 and the terminal portions 39 of the base-side shell 30 can be enlarged as much as the arrangement interval of the receptacle-side terminal fittings 82 is enlarged. This results in better electrical conduction and, therefore, better shielding effects.

Figure 14:
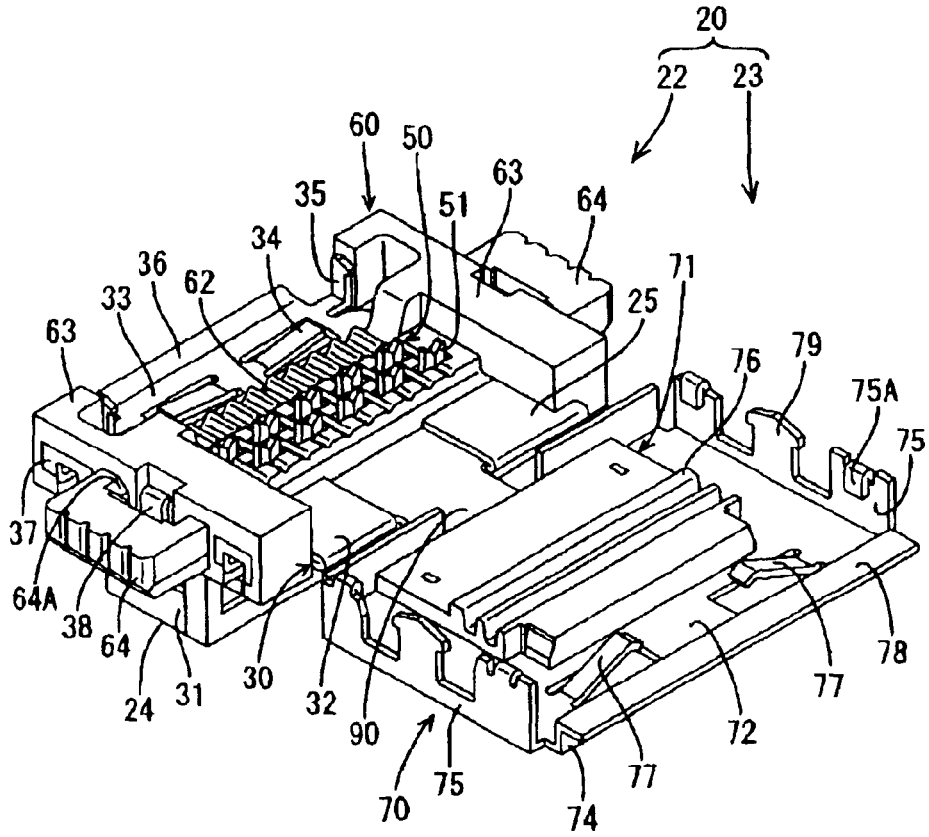
FIG. 14 is a perspective view of a plug according to a second embodiment of the invention.
Figure 15:
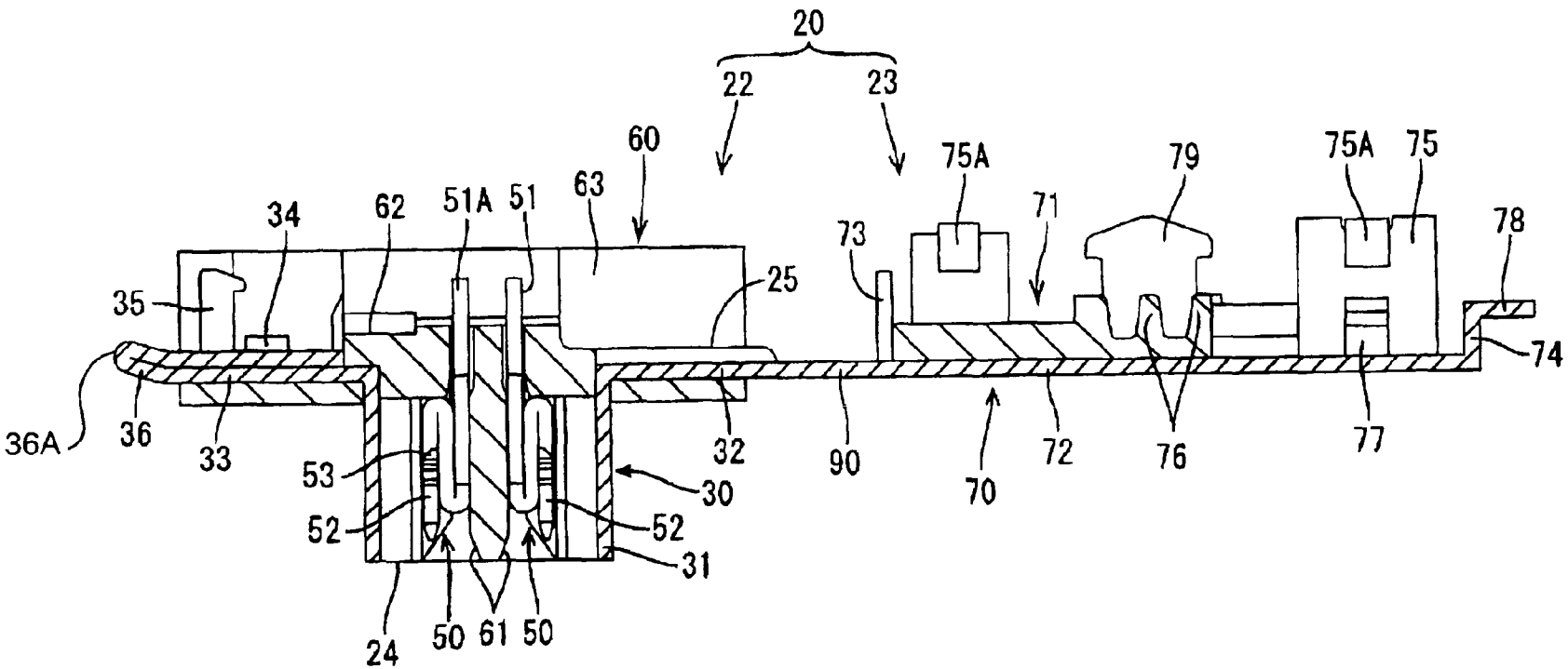
FIG. 15 is a side view in section of the plug of FIG. 14 before complete assembly.
Figure 16:
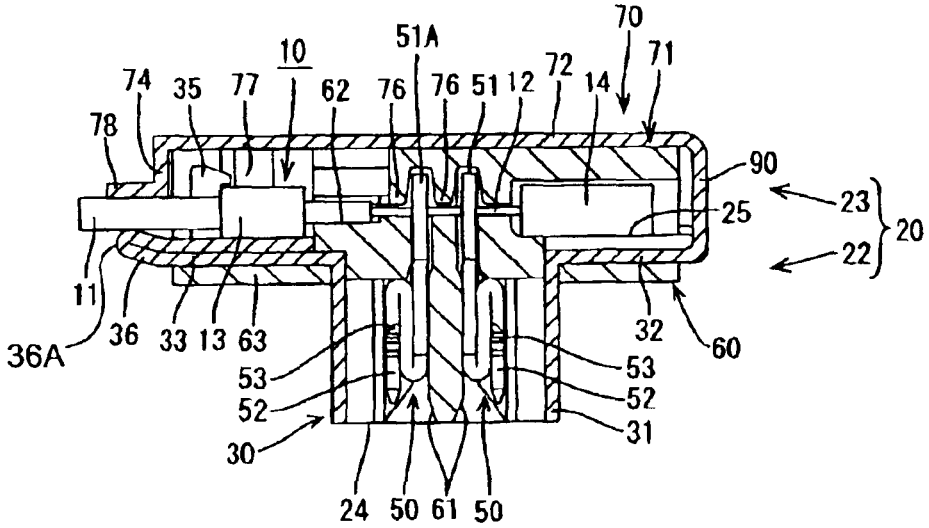
FIG. 16 is a sectional view similar to FIG. 15, but showing a state after the plug is assembled.
Figure 17:
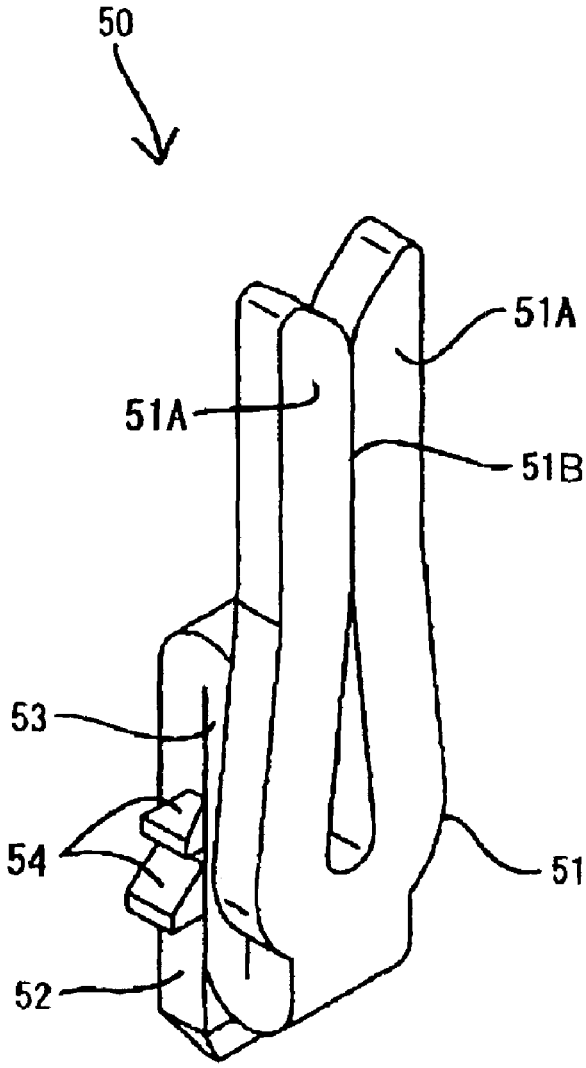
FIG. 17 is a perspective view of the terminal fitting.
Figure 18A:
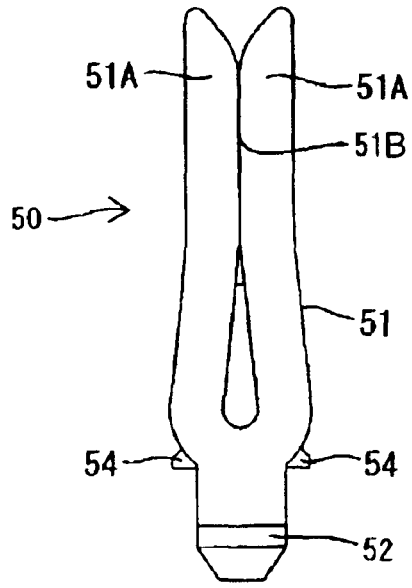
FIG. 18(A) is a front view of the terminal fitting and FIG. 18(B) is a front view showing a core is connected with a wire-squeezing portion.
Figure 18B:
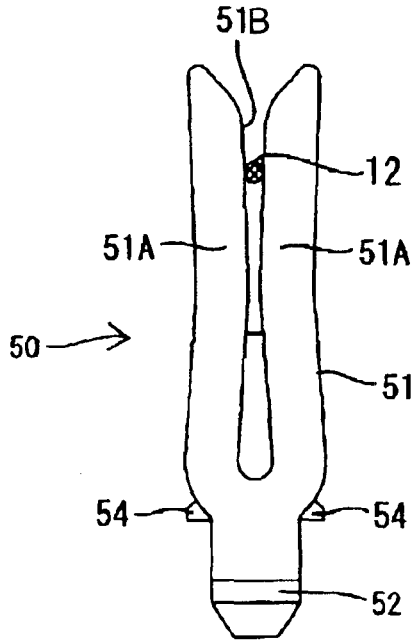

A second embodiment of the invention is illustrated FIGS. 14 to 16. This embodiment is similar to the first embodiment. Similar or identical parts are not described again, but rather merely are identified by the same reference numerals.

In this embodiment, the base-side shell 30 and the lid-side shell 70 are formed unitarily of a single conductive metallic plate and are joined by a bendable coupling piece 90. The coupling piece 90 extends forward from the front end of the front bottom plate 32 of the base-side shell 30 and is coupled to the front end of the lid-side shell 70. During manufacturing, the coupling piece 90 is not bent and is substantially flush with the front bottom plate 32 and the ceiling wall 72. The base-side housing 60 and the lid-side housing 71 are made integral to the base-side shell 30 and the lid-side shell 70, respectively, by insert molding. During assembly, the base 22 and the lid 23 are assembled and closed by bending the coupling piece 90.

This embodiment enables the number of parts to be reduced by unitarily forming the base-side shell 30 and the lid-side shell 70. The two shells 30, 70 can be assembled with each other by bending the coupling piece 90. Thus, it is unnecessary to position the shells 30, 70 with respect to each other during the assembling, and better operability is achieved. Shielding performance may be reduced if a separate base-side shell and the lid-side shell are held in contact with each other poorly. However, this embodiment is free from such a problem and constantly displays a stable shielding performance.

Figure 21A:
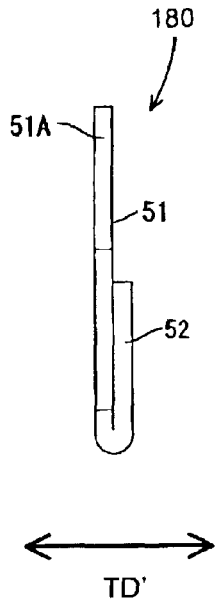
FIGS. 21(A), 21(B) and 21(C) are side views of terminal fittings according to other embodiments.
Figure 21B:
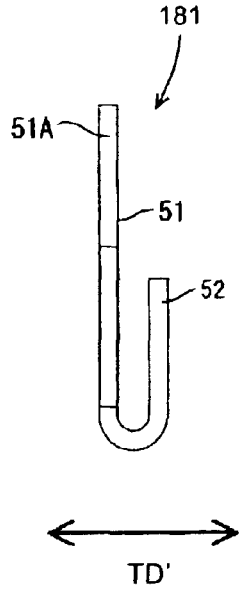
Figure 21C:
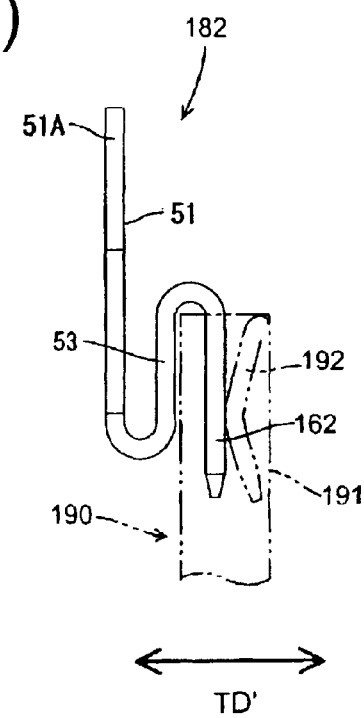
Figure 22:
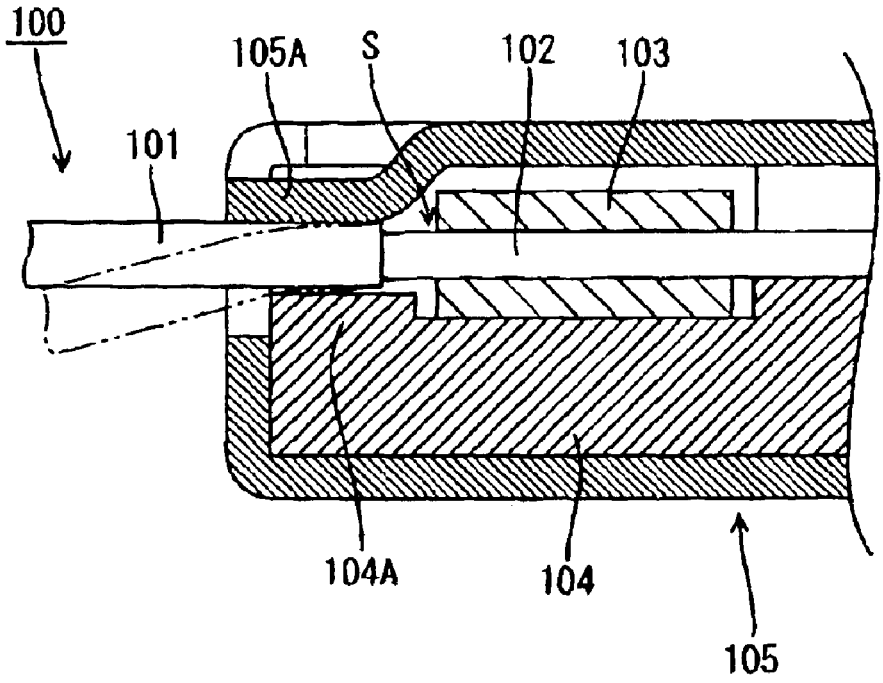
FIG. 22 PRIOR ART
FIG. 22 is a section of a prior art connector.
Figure 23:
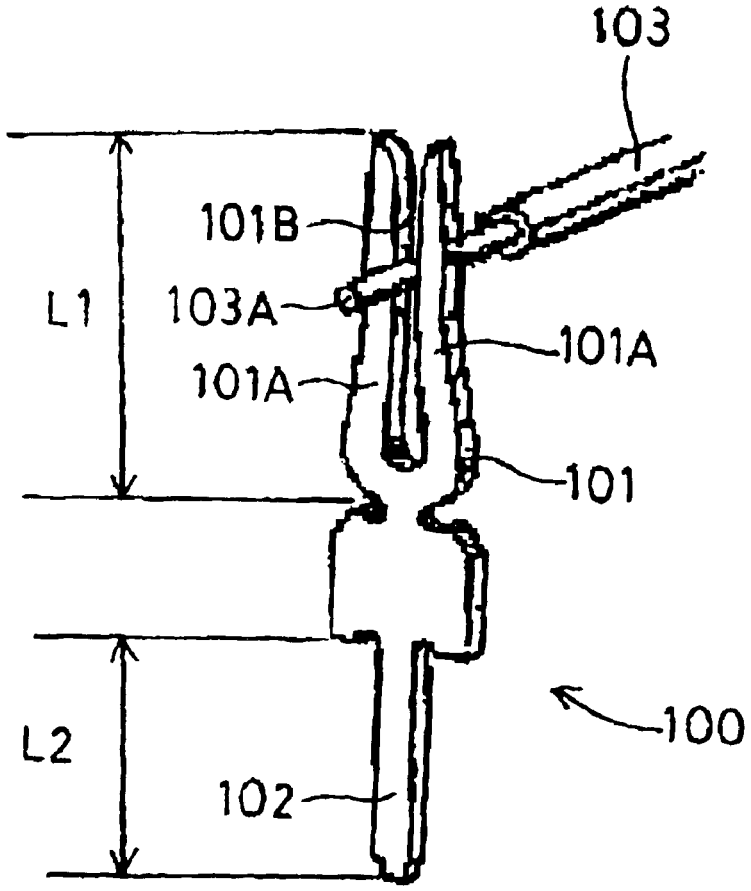
FIG. 23 PRIOR ART
FIG. 23 is a perspective view of a prior art terminal fitting.

FIGS. 21(A), 21(B) and 21(C) show terminal fittings 180, 181, 182 as other embodiments of the present invention. In the respective terminal fittings 180, 181, 182, elements that have substantially the same construction as the first embodiment are identified by the same reference numerals.

The terminal fitting 180 has the wire-squeezing portion 51 and the terminal-connecting portion 52 continuous with each other, and a conductive metallic plate is folded in two to hold the terminal connecting portion 52 against the wire-squeezing portion 51. Thus, a portion corresponding to the coupling portion 53 of the first embodiment is not provided in the terminal fitting 180.

The terminal fitting 181 has the wire-squeezing portion 51 and the terminal connecting portion 52 continuous with each other, and a conductive metallic plate similar to that of the terminal fitting 180 is folded in two so that the wire-squeezing portion 51 and the terminal connecting portion 52 substantially face each other while being spaced apart.

The terminal fitting 182 has the coupling portion 53 between the wire squeezing portion 51 and the terminal connecting portion 52, and a conductive metallic plate is folded at two positions so that the wire squeezing portion 51 and the terminal connecting portion 52 face opposite surfaces of the coupling portion 53, but are spaced apart from the corresponding surfaces. The terminal connecting portion 52 is fittable into a substantially rectangular tube portion 191 of a mating female terminal fitting 190 to resiliently contact a resilient contact piece 192 in the rectangular tube portion 191.

The invention is not limited to the above described and illustrated embodiments. For example, the following embodiment is also embraced by the technical scope of the present invention as defined in the claims. Beside the following embodiment, various changes can be made without departing from the scope and spirit of the present invention as defined in the claims.

A flat cable with shielded cables arranged substantially side by side is connected with the connector in the foregoing embodiments. However, the present invention also is applicable for the connection of shielded cables of other forms, such as FPCs (flexible printed circuits) and ribbon cables.

The base-side shell has a double-plate structure and the folded edge thereof is used to tightly hold the cable in the foregoing embodiment. However, the lid-side shell may be similarly constructed.

The shielding shell is only in the plug-side connector in the foregoing embodiment. However, it may be only in the receptacle-side connector.

An arranging direction of the shielded cables and a connecting direction of the plug-side connector are substantially normal to each other in the foregoing embodiment. However, the invention also is applicable to shielding connectors in which these directions are substantially parallel or at an angle.

The terminal fitting connectable with the end of the flat cable is shown in the foregoing embodiments. However, the invention also is applicable for wires other than flat cables. The present invention also is applicable to insulation displacement terminal fittings in which an insulation coating of a wire is cut by the leading ends of a pair of insulation-displacement blades.

What is claimed is:

1. A shielding connector to be connected with ends of shielded cables, the shielding connector comprising a housing terminal fittings mounted in the housing and being connectable with the respective shielded cables, and a shielding shell substantially covering the housing and being configured for connection with shielding layers of the respective shielded cables the shielding shell comprising a base-side shell and a lid-side shell removably mountable on the base-side shell, the base-side shield and the lid-side shield being formed unitarily with a bendable coupling piece, such that the lid-side shell is mountable on the base-side shell by bending the coupling piece, the base-side shell and the housing being formed integrally to each other by insert molding, such that at least portions of the base-side shell are surrounded by a unitary matrix of material that forms the housing.

2. A shielding connector to be connected with ends of shielded cables, the shielding connector comprising a housing, terminal fittings mounted in the housing and being connectable with the respective shielded cables, and a shielding shell substantially covering the housing and being configured for connection with shielding layers of the respective shielded cables, the shielding shell comprising a base-side shell and a lid-side shell removably mountable on the base-side shell, wherein at least one of the base-side shell and the lid-side shell is formed to have a double-plate structure by folding a conductive plate at a folded edge.

3. The shielding connector of claim 2, wherein the base-side shell and the housing are formed integrally to each other by insert molding, such that at least portions of the base-side shell are surrounded by a unitary matrix of material that forms the housing.

4. The shielding connector of claim 3, wherein the base-side shell and the lid-side shell are formed unitarily with a bendable coupling piece, such that the lid-side shell is mountable on the base-side shell by bending the coupling piece.

5. The shielding connector of claim 2, wherein the base-side shell and the lid-side shell comprise wire pressing portions for squeezing the cable in opposite thickness directions at a rear end position of the housing substantially where the cable is drawn out.

6. The shielding connector of claim 5, wherein the wire-pressing portion comprises the folded edge for contacting the cable.

7. The shielding connector of claim 6, wherein the wire-pressing portion is formed in the base-side shell by bending a portion near the folded edge at a rear end of the connector, so that the wire pressing portion projects in the thickness direction.

8. A shielding connector system, comprising:

a plug-side connector ;

plug-side terminal fittings connectable with shielded cables and held substantially side-by-side along a widthwise direction in a plug-side housing of the plug-side connector;

a receptacle-side connector for mounting on a circuit board;

receptacle-side terminal fittings connectable with the circuit board and held substantially side-by-side along a widthwise direction in a receptacle-side housing of the receptacle-side connector;

the plug-side terminal fittings being connected with the corresponding receptacle-side terminal fittings by connecting the plug-side connector with the receptacle-side connector; and a shielding shell connectable with corresponding shielding layers of the shielded cables in one of the plug-side connector and the receptacle-side connector and comprising a plug-side shielding portion for substantially covering ends of the shielded cables and a receptacle-side shielding portion for substantially covering the receptacle-side terminal fittings.

9. The shielding connector system of claim 8, wherein the shielding shell is provided in the plug-side connector and unitarily comprises terminal portions connectable with at least some of the receptacle-side terminal fittings.

10. The shielding connector system of claim 9, wherein the receptacle-side terminal fittings are arrayed alternately in two rows such that rows of the plug-side terminal fittings are located between the two rows of the receptacle-side terminal fittings.

11. The shielding connector system of claim 10, wherein the plug-side connector is a shield connector.

12. A terminal fitting formed of a long narrow electrically conductive plate, comprising:

a wire squeezing portion including a base and a pair of arms extending substantially side by side from the base and adapted to establish an electrical connection by squeezing a wire between the arms;

a coupling portion extending from a portion of the base opposite the wire squeezing portion and being folded relative to the base to extend back towards the wire squeezing portion; and a flat substantially planar terminal connecting portion in the form of a mating terminal fitting extending from an end of the coupling portion farthest from the connection between the coupling portion and the wire squeezing portion so that the terminal fitting has an S-shape with the coupling portion disposed between and facing sections of the wires squeezing portion and the terminal connecting portion, at least parts of the arms the wire squeezing portions extending beyond the coupling portion and at least part of the terminal connecting portion extending beyond the coupling portion in a direction opposite from the arms of the wire squeezing portion.

* * * * *